US007193497B2

(12) United States Patent
Yeh et al.

(10) Patent No.: US 7,193,497 B2
(45) Date of Patent: Mar. 20, 2007

(54) IGNITION COIL

(75) Inventors: Ming Yeh, Taipei Hsien (TW); Heng Cheng Chou, Taipei Hsien (TW); Chen-Feng Wu, Taoyuan (TW); Chien-Chia Lin, Taoyuan (TW)

(73) Assignee: Delta Electronics Inc., Taoyuan Hsien (TW)

( * ) Notice: Subject to any disclaimer, the term of this patent is extended or adjusted under 35 U.S.C. 154(b) by 138 days.

(21) Appl. No.: 10/757,399

(22) Filed: Jan. 15, 2004

(65) Prior Publication Data

US 2004/0145438 A1 Jul. 29, 2004

Related U.S. Application Data

(63) Continuation-in-part of application No. 09/984,398, filed on Oct. 30, 2001, now Pat. No. 6,734,774.

(30) Foreign Application Priority Data

Oct. 31, 2000 (TW) ..... 89218850 U

(51) Int. Cl.
*H01F 27/30* (2006.01)

(52) U.S. Cl. ..... 336/198; 336/90; 336/192

(58) Field of Classification Search ..... 336/65, 336/90–96, 107, 192, 198; 123/634–635
See application file for complete search history.

(56) References Cited

U.S. PATENT DOCUMENTS

| | | | | |
|---|---|---|---|---|
| 3,711,806 | A * | 1/1973 | Flentge | 336/92 |
| 4,041,430 | A | 8/1977 | Hrynewycz | |
| 4,205,291 | A * | 5/1980 | Flentge | 336/92 |
| 4,683,518 | A | 7/1987 | Gwozdz | |
| 4,924,200 | A | 5/1990 | Kitahara et al. | |
| 4,962,361 | A * | 10/1990 | Ida | 336/90 |
| 5,179,365 | A | 1/1993 | Raggi | |
| 5,791,585 | A * | 8/1998 | Knight et al. | 242/434.7 |
| 5,933,064 | A * | 8/1999 | Hilfiker | 335/132 |

* cited by examiner

*Primary Examiner*—Tuyen T Nguyen
(74) *Attorney, Agent, or Firm*—Birch, Stewart, Kolasch & Birch, LLP

(57) ABSTRACT

An ignition coil. The ignition coil includes a casing, a bobbin, and a core. The bobbin includes a body, a primary coil surrounding the body, a secondary coil surrounding the body, a plurality of first terminals embedded in the body, and two secondary coils embedded in the body. The bobbin is disposed inside the casing. The primary coil is connected to the second terminal, and the secondary coil is connected to the first terminal. Each first terminal is abutted by the body and the casing respectively so that each first terminal is maintained in a predetermined position on the body. The core is disposed inside the bobbin.

28 Claims, 6 Drawing Sheets

IGNITION COIL

CROSS REFERENCE TO RELATED APPLICATION

This is a continuation-in-part application of co-pending U.S. patent application Ser. No. 09/984,398, filed Oct. 30, 2001 now U.S. Pat. No. 6,734,774.

BACKGROUND OF THE INVENTION

1. Field of the Invention

The invention relates to an ignition coil; in particular, the invention relates to an ignition coil with terminals that can be precisely positioned during assembly.

2. Description of the Related Art

An ignition coil ignites combustible gas by high voltage. Referring to FIG. 1*a*, a conventional ignition coil 10 includes a casing 20, a bobbin 30, a primary coil 80 (shown in FIG. 1*b*), two secondary coils 90 (shown in FIG. 1*b*), a circuit (not shown) and a bar core 70. The casing 20 is made of plastic.

The bobbin 30 is disposed inside the casing 20, as shown in FIG. 1*b*. The bobbin 30 is provided with a primary portion 50 and two secondary portions 60. The primary portion 50 separates the secondary portions 60 by partitions (not labeled).

The bobbin 30 further includes two terminals 51 and four pins 62. The primary portion 50 is surrounded by the primary coil 80 as shown in FIG. 1*b*. The primary coil 80 is electrically connected to the terminals 51. The secondary portion 60 is surrounded by the secondary coil 90 as shown in FIG. 1*b*. One end of the secondary coil 90 attaches to one of the pins 62, and the other end of the secondary coil 90 attaches to the other pin 62 by solder.

The bar core 70 penetrates the bobbin 30 to provide a magnetic route. The circuit converts a DC voltage to a triggering-voltage signal. The triggering-voltage signal inputs to the primary coil 80. The D.C. voltage is converted to a high voltage by the voltage conversion of the primary coil 80 and the secondary coil 90. The high voltage ignites the combustible gas through the pins 62 in a tip-discharging manner.

The casing 20 is filled with a resin such as an epoxy resin to prevent high voltage generated by the coil from leaking out of the casing 20 causing dielectric breakdown.

FIG. 1*b* is a schematic view of the assembled ignition coil 10 in FIG. 1*a*. During assembly, the pins 62 must pass through holes 25, formed in the casing 20, to expose their tips. As a result, the filled resin is able to leak out of the casing 20 through the holes 25 with diameter is larger than that of the pin 62. Accordingly, a design in which the diameter of the hole 25 is smaller than the diameter of the pin 62 is provided. However, in such a design, a wire 40, attached to the pin 62, is easily broken when the pin 62 passes through the hole 25, because the diameter of the pin 62 is larger than that of the hole 25, hence, the pin 62 is easily squeezed out of the hole and then the wire 40 may be broken by the movement of the pin 62 as shown in FIG. 1*c*.

Therefore, it is desirable to develop an ignition coil that can prevent attached wire breakage and resin leakage during assembly.

SUMMARY OF THE INVENTION

In order to address the disadvantages of the aforementioned ignition coil, the invention provides an ignition coil that prevents resin leakage.

Another purpose of this invention is to provide an ignition coil that prevents attached wire breakage.

Still another purpose of this invention is to provide an ignition coil with terminals that can be precisely positioned during assembly.

Accordingly, the invention provides an ignition coil including a casing and a bobbin. The bobbin is disposed inside the casing, and includes a body and a plurality of first terminals embedded in the body. Each of the first terminals is abutted by the body and the casing respectively so that each of the first terminals is kept in a predetermined position on the body.

In a preferred embodiment, the bobbin is formed with a plurality of concave portions for receiving the first terminals therein.

In another preferred embodiment, the ignition coil further includes a plurality of pins corresponding to the first terminals respectively. The pins are embedded inside the casing. Each of the first terminals includes a ring-shaped portion in contact with the corresponding pin. Each of the ring-shaped portions is abutted by the body and the casing respectively. Each of the pins is surrounded by the corresponding ring-shaped portion and contacts the corresponding first terminal. Each of the first terminals further includes a protruding portion integrally formed with the ring-shaped portion.

In another preferred embodiment, the bobbin further includes a primary portion and a secondary portion. The ignition coil further includes a primary coil surrounding the primary portion and a secondary coil surrounding the secondary portion. The secondary coil is connected to the first terminals. The bobbin further includes two second terminals connected to the primary coil. The second terminals are embedded in the body.

In another preferred embodiment, the ignition coil further includes a core disposed inside the bobbin. It is understood that the casing may be made of plastic, and each of the pins may be made of metal.

In this invention, another ignition coil is provided. The ignition coil includes a casing, a bobbin, a primary coil, a secondary coil, and a core. The bobbin includes a body, a plurality of first terminals embedded in the body, and two second terminals embedded in the body. The bobbin is disposed inside the casing. The primary coil surrounds the body, and is connected to the second terminals. The secondary coil surrounds the body, and is connected to the first terminals. Each of the first terminals is abutted by the body and the casing respectively so that each of the first terminals is maintained in a predetermined position on the body. The core is disposed inside the bobbin.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

Figure 1A:
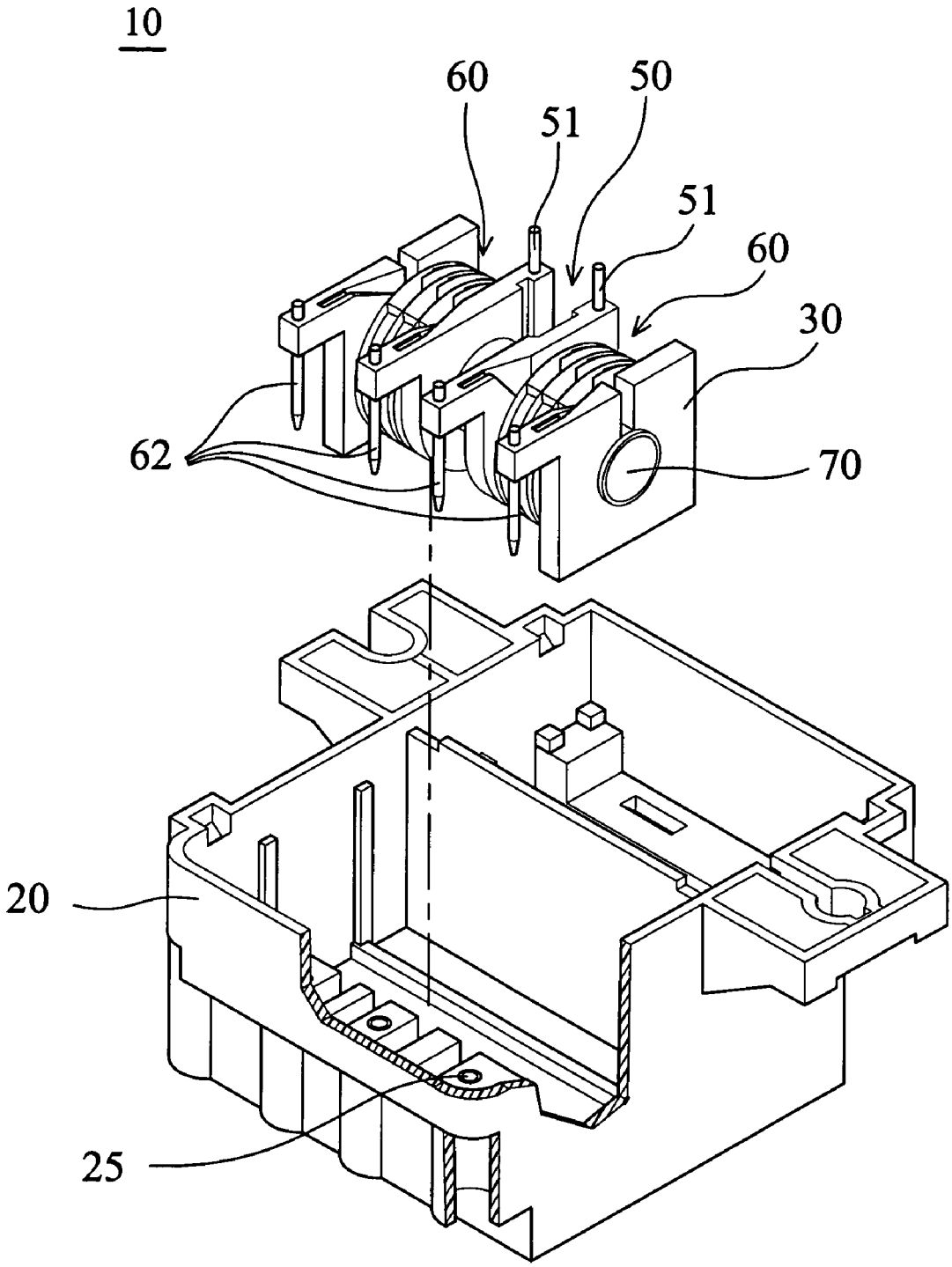
FIG. 1a ( RELATED ART )
FIG. 1*a* is a schematic view of a conventional ignition coil.
Figure 1B:
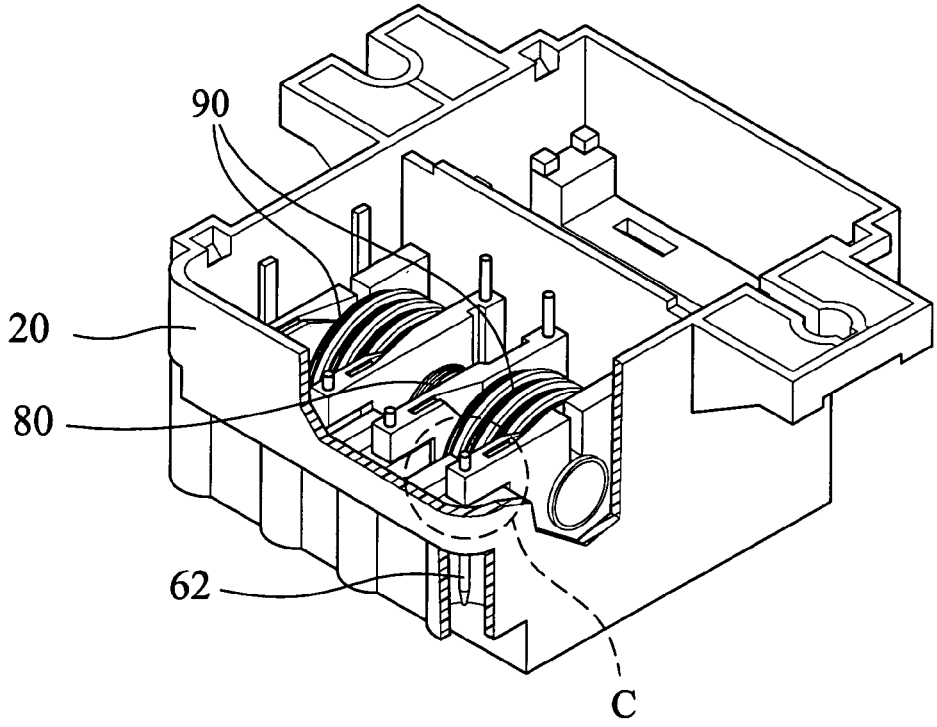
FIG. 1b ( RELATED ART )
FIG. 1*b* is a schematic view of the assembled ignition coil in FIG. 1*a;*
Figure 1C:
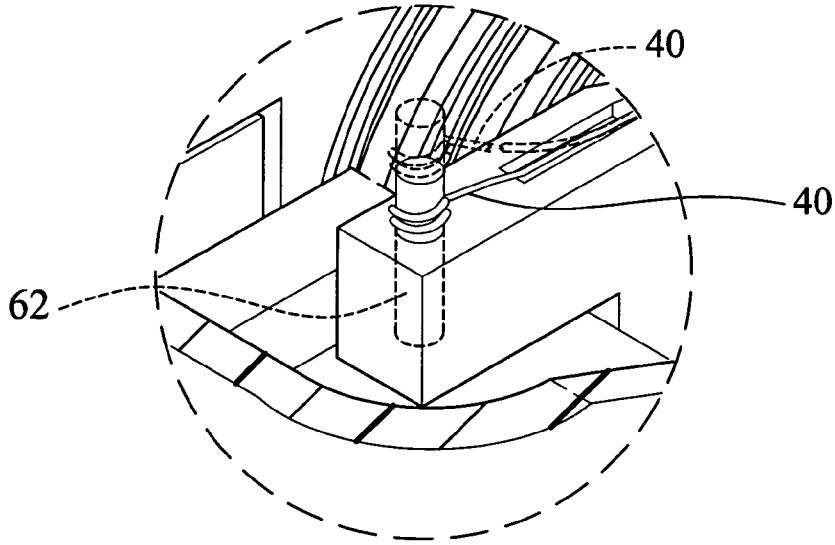
FIG. 1c ( RELATED ART )
FIG. 1*c* is an enlarged view of part C in FIG. 1*b;*
Figure 2A:
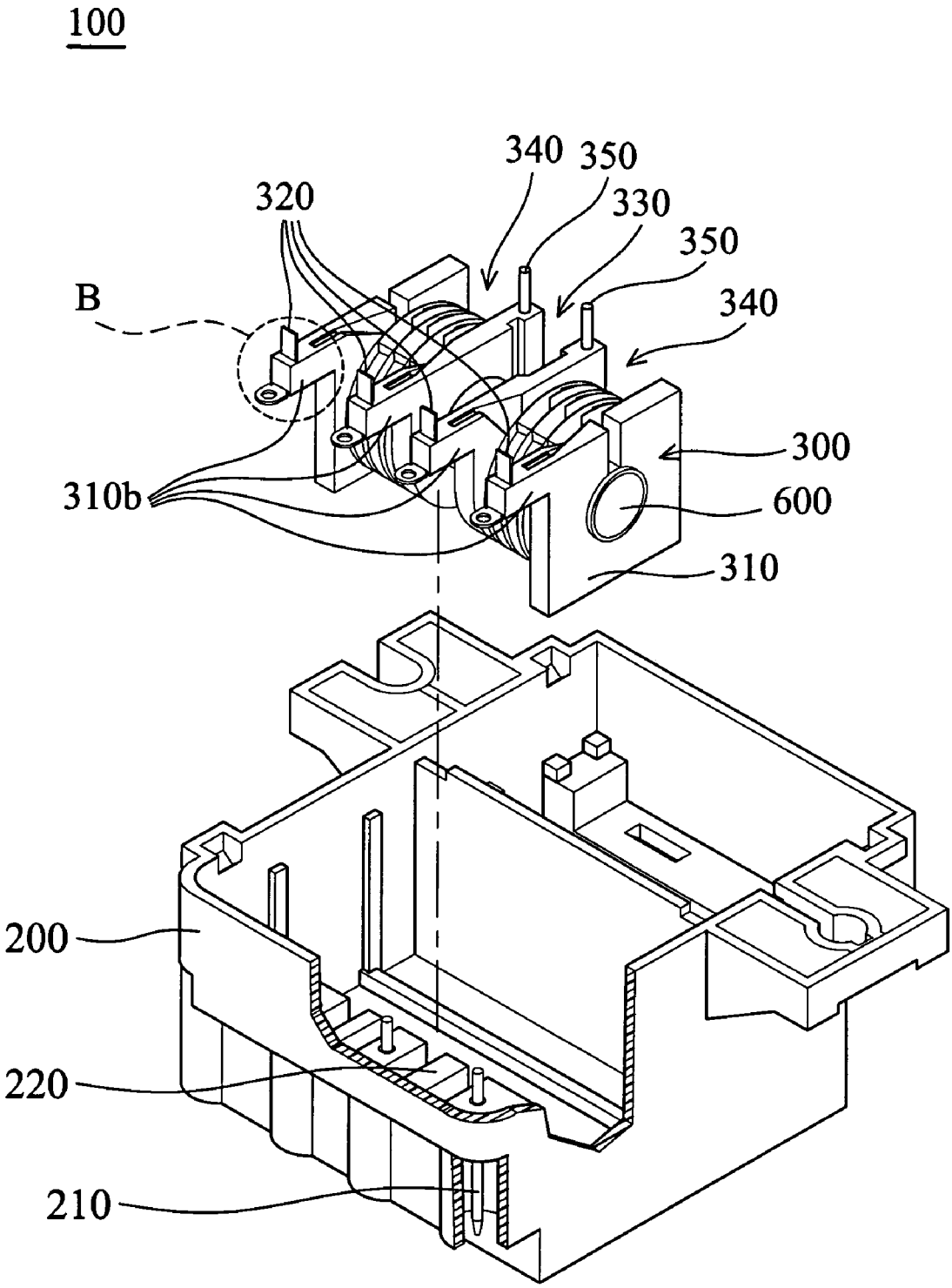
FIG. 2*a* is a schematic view of an ignition coil as disclosed in this invention.
Figure 2B:
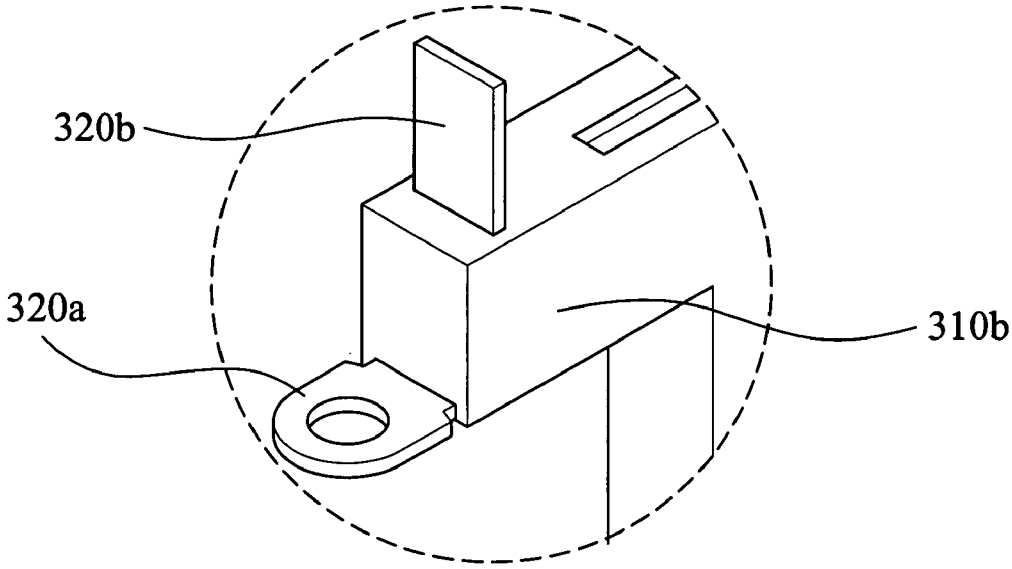
FIG. 2*b* is an enlarged view of part B in FIG. 2*a;*
Figure 4A:
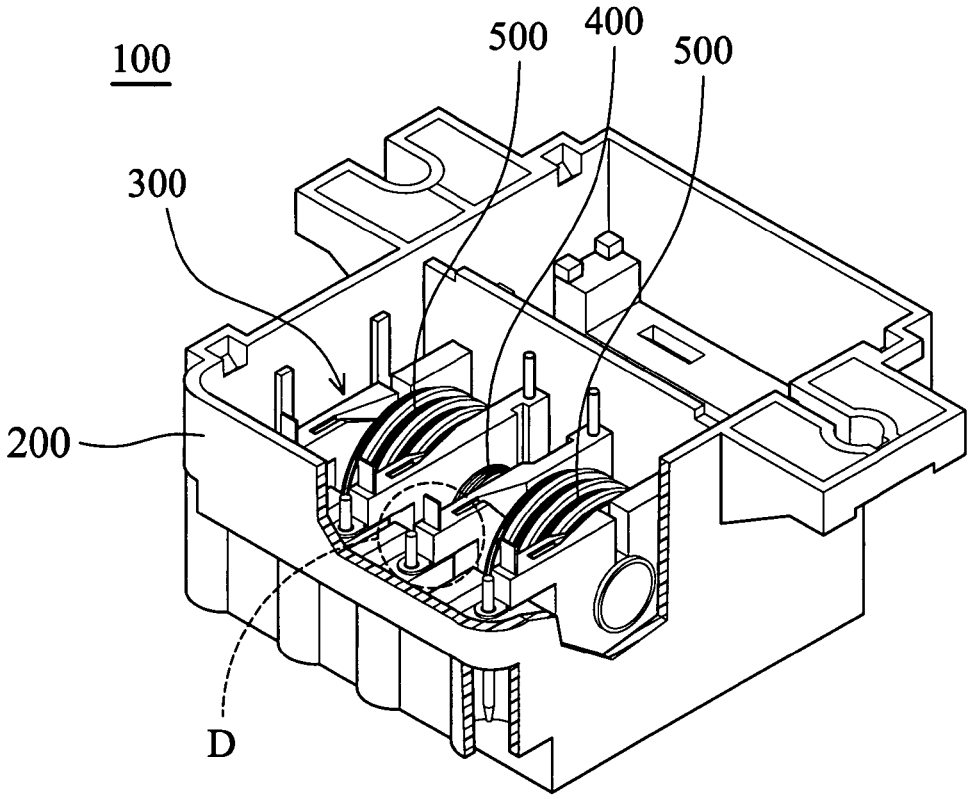
FIG. 4*a* is a schematic view of the assembled ignition coil in FIG. 2*a*.

Referring to FIG. 2*a* and FIG. 4*a*, an ignition coil 100, as disclosed in this invention, includes a casing 200, four pins 210, a bobbin 300, a primary coil 400, two secondary coils 500, a circuit (not shown), and a bar core 600. It is noted that the primary coil 400 and the secondary coils 500 are omitted in FIG. 2*a*.

Figure 3:
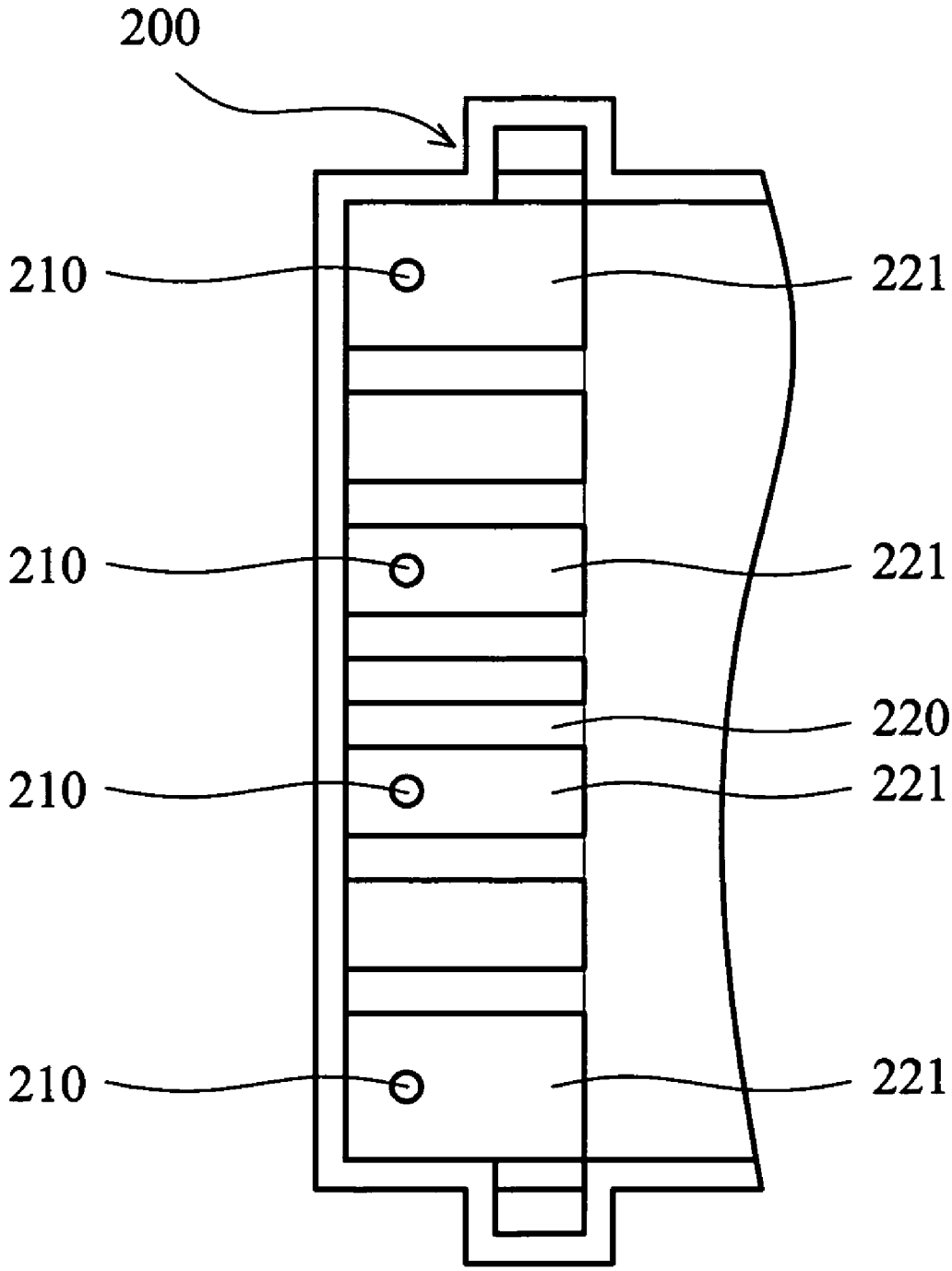
FIG. 3 is a partially top view of a casing in FIG. 2*a;*

Referring to FIG. 3, the casing 200 is provided with a base 220 therein, and is made of plastic. The base 220 is formed with four supporting portions 221 thereon. The pins 210 are disposed inside the casing 200 by air pressing, and are made of metal. Specifically, each of the pins 210 is located in one of the supporting portions 221 of the base 220 respectively.

The bobbin 300 is disposed inside the casing 200, as shown in FIG. 4*a*. The bobbin 300 is provided with a primary portion 330 and two secondary portions 340. The secondary portions 340 are electrically separated by the primary portion 330.

Figure 2C:
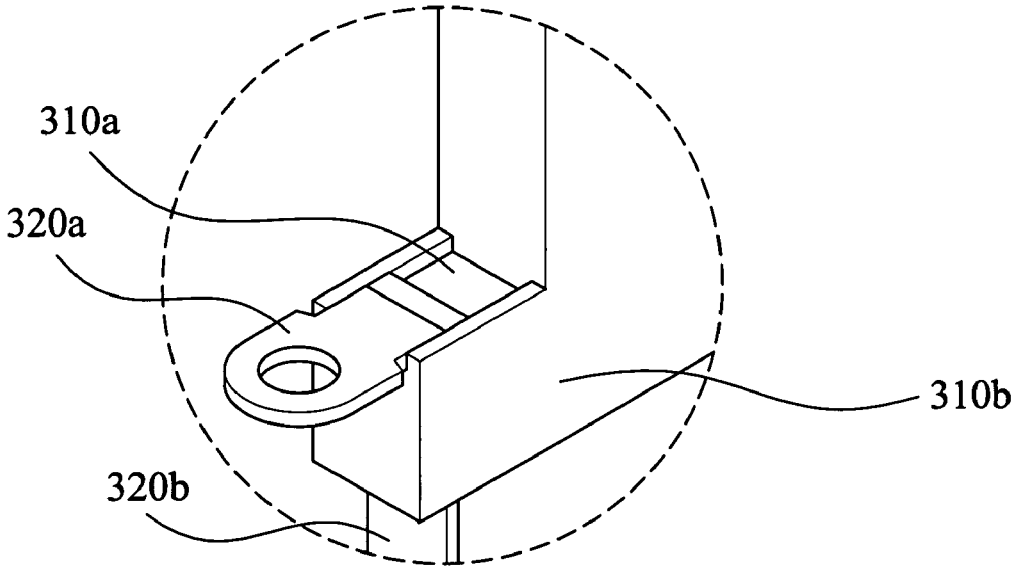
FIG. 2*c* is another enlarged view, viewed from another angle, of part B in FIG. 2*a;*

The bobbin 300 includes a body 310, four first terminals 320, and two second terminals 330. The body 310 is a basic component of the bobbin 300, and has four protrusions 310*b*, corresponding to the supporting portions 221 of the base 220 of the casing 200, for holding the first terminals 320 respectively. Referring to FIG. 2*c*, each of the protrusions 310*b* is formed with a concave portion 310*a* for receiving the first terminal 320 therein. The first terminals 320 correspond to the pins 210 on the casing 200 respectively, and are embedded in the body 310 by air pressing. Each of the first terminals 320 is provided with a ring-shaped portion 320*a* and a protruding portion 320*b* integrally formed with the ring-shaped portion 320*a*. Each of the ring-shaped portions 320*a* surrounds the corresponding pin 210 and is electrically in contact with the corresponding pin 210.

Figure 4B:
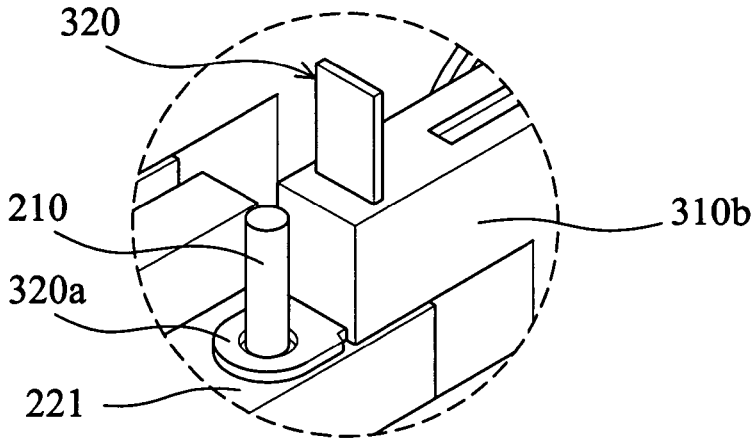
FIG. 4*b* is an enlarged view of part D in FIG. 4*a*.

Referring to FIG. 4*b*, after the bobbin 300 is disposed inside the casing 200, each of the first terminals 320 is abutted by the protrusion 310*b* of the body 310 and the supporting portion 221 of the base 220 of the casing 200 respectively so that each of the first terminals 320 can be maintained in a predetermined position on the body 310 during assembly.

The primary portion 330 of the bobbin 300 is surrounded by the primary coil 400, and the secondary portions 340 thereof are surrounded by the secondary coils 500 respectively. The primary coil 400 is connected to the second terminals 350. Each of the secondary coils 500 is connected to the first terminals 320 respectively, for instance, by soldering. Specifically, one end of the secondary coil 500 is connected to the protruding portion 320*b* of one of the first terminals 320, and the other end of the secondary coil 500 is connected to the protruding portion 320*b* of the other first terminal 320. As stated above, since the ring-shaped portion 320*a* of the first terminal 320 is formed in ring shape, each ring-shaped portion 320*a* surrounds the corresponding pin 210. As a result, the wire, extending from the secondary coil 500 and attached to the first terminal 320, is not squeezed and damaged. In addition, since the pins 210 are disposed inside the casing 200, no hole is formed on the casing 200, eliminating potential resin leakage from the casing 200.

Further, the bar core 600 penetrates the bobbin 300 to provide a magnetic route. The circuit converts a DC voltage to a triggering-voltage signal. The triggering-voltage signal inputs to the primary coil.

In conclusion, since the pins are not subject to pressure, the wire damage is prevented. Additionally, since the pins 210 are disposed inside the casing 200, potential resin leakage from the casing 200 is eliminated. Moreover, since the first terminal is stably positioned between the bobbin and the casing, the wire attached to the first terminal is not squeezed and damaged.

While the invention has been described by way of example and in terms of the preferred embodiment, it is to be understood that the invention is not limited to the disclosed embodiment. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An ignition coil comprising:

a casing; and a bobbin, including a body and a plurality of first terminals embedded in the body, disposed inside the casing, wherein the body and the casing simultaneously abut each of the first terminals so that each of the first terminals is maintained in a predetermined position on the body;

a plurality of pins, corresponding to the first terminals respectively, embedded inside the casing.

2. The ignition coil as claimed in claim 1, wherein the bobbin is formed with a plurality of concave portions for receiving the first terminals therein.

3. The ignition coil as claimed in claim 2, wherein the bobbin is formed with a plurality of protrusions for holding the first terminals therein, and each concave portion is formed at one of the protrusions respectively.

4. The ignition coil as claimed in claim 1, wherein each of the first terminals includes a ring-shaped portion in contact with the corresponding pin.

5. The ignition coil as claimed in claim 4, wherein each ring-shaped portion is abutted by the body and the casing respectively.

6. The ignition coil as claimed in claim 4, wherein each of the pins is surrounded by the corresponding ring-shaped portion to contact the corresponding first terminal.

7. The ignition coil as claimed in claim 4, wherein each of the first terminals further includes a protruding portion integrally formed with the ring-shaped portion.

8. The ignition coil as claimed in claim 4, wherein the casing is provided with a base in which the pins are disposed, and each ring-shaped portion is abutted by the base.

9. The ignition coil as claimed in claim 8, wherein the base is formed with a plurality of supporting portions to be abutted by the ring-shaped portions.

10. The ignition coil as claimed in claim 1, wherein the bobbin further includes a primary portion and a secondary portion.

11. The ignition coil as claimed in claim 10, further comprising:

a primary coil surrounding the primary portion; and a secondary coil, surrounding the secondary portion, connected to the first terminals.

12. The ignition coil as claimed in claim 11, wherein the bobbin further comprises:

two second terminals, connected to the primary coil, embedded in the body.

13. The ignition coil as claimed in claim 1, further comprising:

a core disposed inside the bobbin.

14. The ignition coil as claimed in claim 1, wherein the casing is made of plastic.

15. The ignition coil as claimed in claim 4, wherein each of the pins is made of metal.

16. An ignition coil comprising:

a casing;

a bobbin including a body, a plurality of first terminals embedded in the body, and two second terminals embedded in the body, wherein the bobbin is disposed inside the casing, and the body and the casing simultaneously abut each of the first terminals so that each of the first terminals is maintained in a predetermined position on the body;

a primary coil, surrounding the body of the bobbin, connected to the second terminals;

a secondary coil, surrounding the body of the bobbin, connected to the first terminals; and a core disposed inside the bobbin;

a plurality of pins, corresponding to the first terminals respectively, embedded inside the casing.

17. The ignition coil as claimed in claim 16, wherein the bobbin is formed with a plurality of concave portions for receiving the first terminals therein.

18. The ignition coil as claimed in claim 17, wherein the bobbin is formed with a plurality of protrusions for holding the first terminals therein, and each of the concave portions is formed at one of the protrusions respectively.

19. The ignition coil as claimed in claim 17, wherein each of the first terminals includes a ring-shaped portion contacting each corresponding pin.

20. The ignition coil as claimed in claim 19, wherein each ring-shaped portion is abutted by the body and the casing respectively.

21. The ignition coil as claimed in claim 19, wherein each pin is surrounded by the corresponding ring-shaped portion to contact each corresponding first terminal.

22. The ignition coil as claimed in claim 19, wherein each first terminal further includes a protruding portion integrally formed with the ring-shaped portion.

23. The ignition coil as claimed in claim 19, wherein the casing is provided with a base in which the pins are disposed, and each ring-shaped portion is abutted by the base.

24. The ignition coil as claimed in claim 23, wherein the base is formed with a plurality of supporting portions to be abutted by the ring-shaped portions.

25. The ignition coil as claimed in claim 16, wherein the bobbin further comprises:

a primary portion surrounded by the primary coil; and a secondary portion surrounded by the secondary coil.

26. The ignition coil as claimed in claim 16, wherein the casing is made of plastic.

27. The ignition coil as claimed in claim 17, wherein each of the pins is made of metal.

28. The ignition coil as claimed in claim 16, wherein the bobbin further comprises:

two second terminals, connected to the primary coil, embedded in the body.

* * * * *